United States Patent [19]

Jonsson

[11] Patent Number: 4,637,477

[45] Date of Patent: Jan. 20, 1987

[54] DEVICE IN ROCK DRILLING MACHINES

[75] Inventor: Nils G. Jonsson, Täby, Sweden

[73] Assignee: Craelius AB, Marsta, Sweden

[21] Appl. No.: 696,924

[22] Filed: Jan. 13, 1985

[30] Foreign Application Priority Data

Feb. 3, 1984 [SE] Sweden ..... 8400574

[51] Int. Cl.[4] ..... B23Q 5/00

[52] U.S. Cl. ..... 173/149; 173/152

[58] Field of Search ..... 173/53, 54, 152, 149, 173/DIG. 3, 163, 164, 167; 409/904, 231, 238, 239; 279/4; 384/121, 113, 100

[56] References Cited

U.S. PATENT DOCUMENTS

| | | | |
|---|---|---|---|
| 3,165,365 | 1/1965 | Wiedemann et al. | 384/121 |
| 3,565,187 | 2/1971 | Jonsson | 173/152 |
| 3,827,707 | 8/1974 | Sinner | 384/113 |
| 4,090,743 | 5/1978 | Suzuki et al. | 384/113 |
| 4,262,756 | 4/1981 | Blanz | 173/149 |
| 4,383,771 | 5/1983 | Freytag et al. | 384/121 |

*Primary Examiner*—Donald R. Schran
*Assistant Examiner*—James L. Wolfe
*Attorney, Agent, or Firm*—Barnes & Thornburg

[57] ABSTRACT

A device in rock drilling machines with a gripping device (24) which is rotatably mounted in a non-rotating drilling head (14) and intended to grip a drill string (21) for transferring rotational and axial movements to it. The gripping device is hydrostatically mounted (42, 43, 45–49) in the drilling head, whereby the pressure in a pressurized fluid between their coacting bearing surfaces (42, 43) automatically increases for increased loading pressure between these surfaces.

12 Claims, 4 Drawing Figures

DEVICE IN ROCK DRILLING MACHINES

BACKGROUND OF THE INVENTION

1. Field of the Invention

The present invention generally relates to a device in rock drilling machines with a gripping device which is rotatably mounted in a non-rotating drilling head and is intended to grip a drill string for transmitting rotational and axial movement to the string, and more specifically to the mounting of the gripping device in the drilling head.

2. Description of the Prior Art

Different rock drilling methods set different demands on rotational speed and feed force applied to the drill string. In diamond drilling, for example, high rotational speeds and relatively small feed forces are used (500–2000 r.p.m. and 5–20 kN), while low speeds and large feed forces (50–200 r.p.m. and 50–200 kN) are used for drilling with roller bits. Another method is percussion drilling.

These different methods place different demands, particularly on the thrust bearing between the drilling head and the gripping device, which are difficult to meet in one and the same structure.

The U.S. Pat. No. 3,565,187 teaches a pressurized medium activated gripping device which is rotatably mounted in a drilling head. The mounting comprises rolling bearings which take up both axial and radial forces which are propagated to the drilling head and gripping device via the drill string.

Typical for rolling bearings is sensibility to shock stresses, and therefore in the known structure one has had to use special rubber dampers if percussion drilling has to be carried out. Neither can the bearings take up large axial loads, particularly not in combination with high rotational speeds.

SUMMARY OF THE INVENTION

One object of the present invention is to achieve a device of the kind described in the introduction which constitutes an improvement of previously known means, including the means in accordance with the above mentioned patent specification.

This object is achieved primarily by the gripping device being hydrostatically mounted in the drilling head, whereby the pressure in a pressurized fluid between their coacting bearing surfaces automatically increases for increased loading pressure between the surfaces.

With the hydrostatic mounting in accordance with the invention it is achieved that large axial forces can be taken up with small frictional losses even for high rotational speeds and percussion drilling without using special dampers, that the costs for the mounting can be kept low, particularly if the pressurized medium which is used in the mounting can also be utilized for activating the gripping device and that operational reliability and life increase. Furthermore, there is achieved that the axial feed force on the drill string can be measured very accurately by connecting a pressure indicator directly to the mounting.

PREFERRED EMBODIMENT

Figure 1:
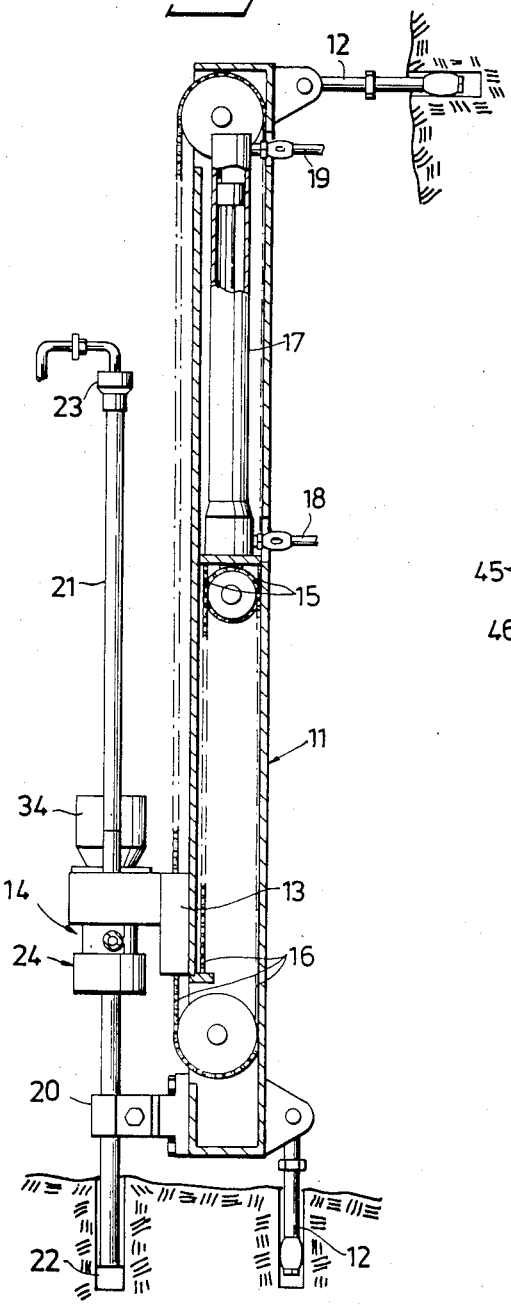
FIG. 1 is a side view, partially in section, of a rock drilling machine including the device in accordance with the invention.

The rock drilling machine illustrated in FIG. 1 is equipped with a feed bar 11 which is supported by expansion bolts 12. Alternatively, the feed bar 11 may be carried by a wheeled substructure or be supported in some other way if such is found to be suitable. A slide 13, carrying a drilling head 14 is slidable along the feed bar 11 by means of two parallel chains 15, a chain 16, and a feed cylinder 17 having two pressurized medium inlets 18 and 19. There is a drill holder 20 on the forward end of the feed bar 11, the holder being disposed for guiding a drill string during drilling, in this case a jointed drill pipe 21, and also for gripping the drill pipe to prevent rotation and axial movement thereof during such as jointing or breaking joints. A diamond drill bit 22 is screwed on to the forward part of the drill pipe, and flushing water is supplied via a swivel 23, which is screwed on to the end of the drill pipe. In the drilling head 14, illustrated in section in FIG. 2, there is mounted a gripping device or chuck 24. This chuck has a housing 25 with an extended sleeve portion 26 which is rotatably mounted in the housing 27 of the drilling head 14 with the aid of a roller bearing 28 and a ball bearing 29.

A reversible, hydraulic rotary motor 34 which is attached to the drilling head 14 is arranged for rotating the chuck 24 by a gearing including a gear 35 attached to the motor shaft and a gear 36 attached to the sleeve portion 26.

A pressurized medium, preferably pressurized oil, is supplied to a radial duct 30 in a ring 31 screwed into the housing. The duct 30 is in communication with six axial ducts 32 bored in the sleeve portion 26 by an annular groove 33 made in the sleeve portion. The ducts 32 are in communication with the gripping device 24 which includes gripping jaws 44 (indicated in FIG. 3) and which are actuated for gripping and releasing the drill pipe 21. This gripping device can be of any suitable kind at all, but is suitably a pressurized medium activated gripping device illustrated in the above mentioned U.S. Pat. No. 3,565,187.

The ring 31 has an inner circumferential surface which, together with an exterior circumferential surface on the sleeve portion 26, defines an annular gap 37, which has the primary objects of leading pressurized oil to the gripping device 24 and constituting a primary constriction of constant cross section for purposes described below, and the secondary object of forming a hydrodynamic bearing for the sleeve part 26, as a supplement to the mounting achieved in a radial direction by the rolling bearings 28 and 29 of the chuck 24 in the housing 27.

Pressurized oil supplied to the duct 30 and groove 33 when the gripping device 24 is to be activated for gripping the drill pipe 21, penetrates into the annular gap 37 by leakage between the mutually coacting circumferential surfaces of the sleeve portion and ring. The higher the pressure of the oil is, and thereby the gripping force on the drill pipe, the more oil leaks into the gap 37.

Figure 2:
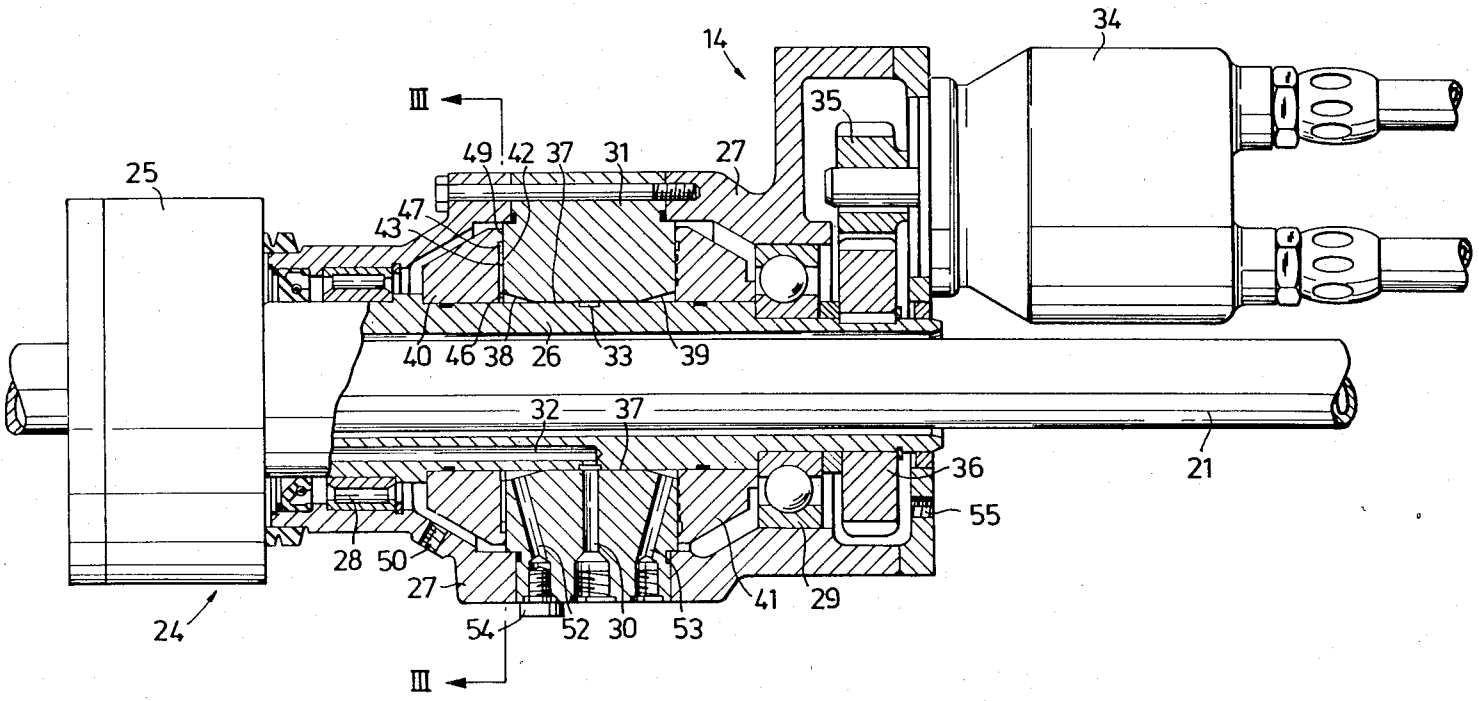
FIG. 2 is a side view, partially in section, of the device in accordance with the invention.

When the oil has passed the gap 37 it is taken by a chamber 38 to the left of the groove 33 in FIG. 2 between an annular bearing surface 42 on the ring 31 and a coacting annular bearing surface 43 on a ring 40 attached to the sleeve portion 26. The oil is also taken, via a chamber 39 to the right of the groove 33, between the bearing surfaces on the ring 31 and another ring 41 attached to the portion 26, but the latter bearing surfaces will not be described in detail since they are identical with the former bearing surfaces 42 and 43.

Figure 3:
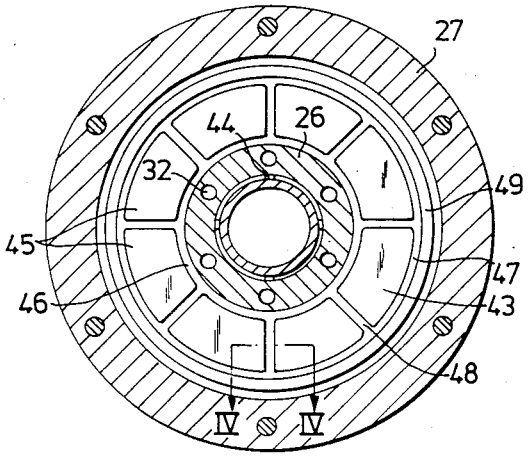
FIG. 3 is a section along the line III—III in FIG. 2.

The bearing surface 42 is smooth, whereas the bearing surface 43 is equipped with eight segments 45, as will be seen from FIG. 3, these segments being defined by two annular grooves 46 and 47 and eight radial grooves 48. These grooves 46, 47 and 48 are intercommunicating and ensure that the oil pressure spreads out over the entire bearing surfaces 42 and 43. A sealing ridge 49 is formed at the circumference of the ring 40 and is situated in substantial the same radial plane as the sealing surfaces of the segments 45, and together with the bearing surface 42 forms the secondary constriction of the hydrostatic bearing.

When the oil pressure increases to activate the gripping device 24 for gripping the drill pipe 21, the oil flow to the space between the bearing surfaces 42 and 43 also increases, thus forming an oil cushion between them, which reduces the friction between the surfaces 42 and 43, and thus also between the drilling-head 14 and chuck 24 when the latter is rotated. For increased axial load on the chuck 24 to the right in FIG. 2, e.g. for percussion drilling, the surface 43 is pressed towards the surface 42, resulting in that the ridge 49 is also pressed towards the surface 42. This results in that the oil pressure between the surfaces 42 and 43 increases in proportion to the applied axial force. Oil which is constantly supplied to the space between the surfaces 42 and 43 via the gap 37 and chamber 38 ensures that the high pressure is maintained so that neither the gap between the ridge 49 and surface 42 nor the space between the surfaces 42 and 43 are closed off, whereby the risk of seizing is eliminated. After having passed the gap 37 the oil jets freely into the housing 27 for further conveyance to the tank (unillustrated) via outlets 50 and 55.

Figure 4:
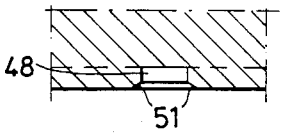
FIG. 4 is a section substantially along the line IV—IV in FIG. 3.

If the chuck 24 is rotated without pressurized oil being supplied to the duct 30 the bevels 51 in the grooves (see FIG. 4) together with the surfaces of the segments 45 form a slipper bearing which prevents seizing. Since the chuck does not grip the drill pipe 21 and is therefore not subjected to any axial stresses, it will only subject the bearing 42, 43, 45–49 to its own weight when it is rotated, and the bearing will stand up to this without being supplied with oil under pressure.

If it is found necessary, or if the gripping device used is not actuated by pressurized medium, e.g. it is a manually actuable screw means, pressurized oil may be supplied to the chambers 38 and 39 via ducts 52 and 53 in the ring 31 from a separate pressure source (not shown), the hydrostatic bearing 42, 43, 45–49 then being able to take up large axial forces with small frictional losses (even for percussion drilling), irrespective of whether the gripping device is actuated or not.

A pressure indicator 54, such as a manometer or a pressure transducer, is mounted on the drilling head 14 to connect with the duct 52, which is illustrated in FIG. 2. This indicator is directly actuated by the oil pressure in the duct 52 and thus directly by the pressure in the chamber 38 and in the oil cushion between the bearing surfaces 42 and 43. Since this pressure is proporttional to the axial forces applied to the chuck 24 and corresponds directly to them, and since the measurement is made in the immediate vicinity of the place where the forces from drill pipe and chuck are taken up by the drilling head 14, very exact values of these forces are obtained on the indicator 54. These values are thus not distorted by friction and other losses which occur if the axial pressure measurement is carried out conventionally, namely by measuring the input pressure in the hydraulic feed cylinder 17. If the measurement is carried out in this conventional manner, it is effected by the friction in the measuring cylinder 17, in the chain transmission 15, 16 and between the slide 13 and feed bar 11. The error in measurement which can thus occur may obtain 10–30%, which negatively effects the life and performance of the drill bit 22, since the force with which the bit is forced against the bottom of a drill hole will not be given the correct value.

Although only one embodiment of the invention has been shown on the drawings and described above, it will be understood that the invention is not limited to this embodiment but only by the disclosures in the claims.

I claim:

1. Device in rock drilling machines with a gripping device which is rotatably mounted in a non-rotating drilling head and intended to grip a drill string for transferring rotational and axial movements thereto, characterized in that the gripping device (24) is hydrostatically mounted (42, 43, 45–49) in the drilling head (14) whereby the pressure in a pressurized fluid between their coacting bearing surfaces (42, 43) automatically increases for increased loading pressure between these surfaces, the hydrostatic mounting including a chamber (38, 39) between coacting and mutually relatively rotating first surfaces on the gripping device and the drilling head, said chamber being supplied with pressurized fluid from a pressurized fluid source for further distribution to the bearing surfaces (42, 43), and also a variable constriction gap (49) proportional to the axial pressure on the drill string (21) in conjunction with coacting and mutually relatively rotating second surfaces on the gripping device and drilling head, the pressurized fluid being taken away from the bearing surfaces via said constriction gap.

2. Device in rock drilling machines with a gripping device which is rotatably mounted in a non-rotating drilling head and intended to grip a drill string for transferring rotational and axial movements thereto, characterized in that the gripping device (24) is hydrostatically mounted (42, 43, 45–49) in the drilling head (14) whereby the pressure in a pressurized fluid between their coacting bearing surfaces (42, 43) automatically increases for increased loading pressure between these surfaces, the hydrostatic mounting including a substantially constant primary constriction (37) between coacting and mutually relatively rotating first surfaces on the gripping device (24) and drilling head (14), through which primary constriction pressurized fluid is supplied to the bearing surfaces (42, 43), the bearing also including a secondary constriction (49) variable in response to the axial pressure acting on the drill string (21), the secondary constriction being in connection with coacting and mutually relatively rotating second surfaces (42, 43) on the gripping device and drilling head, pressurized fluid being taken away from the bearing surfaces via said constriction.

3. Device as claimed in claim 2, characterized in that the primary constriction (37) preferably forms a further bearing between said first surfaces and is supplied with leaking pressurized fluid from a pressurized fluid system for actuation of the gripping device (24).

4. Device in rock drilling machines with a gripping device which is rotatably mounted in a non-rotating drilling head and intended to grip a drill string for transferring rotational and axial movements thereto, characterized in that the gripping device (24) is hydrostatically mounted (42, 43, 45–49) in the drilling head (14) whereby the pressure in a pressurized fluid between their coacting bearing surfaces (42, 43) automatically increases for increased loading pressure between these surfaces, the drilling head (14) including a preferably annular element (31) with two annular bearing surfaces (42) situated axially spaced from each other, and in that the gripping device includes two annular bearing surfaces (40, 41) on either side of said element, one bearing surface on the element and a coacting bearing surface on the gripping device take up axial forces acting on the drill string in one direction, and the other bearing surface on the element and a coacting bearing surface on the gripping device take up axial forces acting on the drill string in the opposite direction.

5. In combination with a gripping device (24) for gripping an elongated member (21) such as a drill rod string to facilitate movement of the elongated member (21) axially by the application of axial force to the gripping device (24), an inner sleeve portion (26) surrounding the elongated member (21), the sleeve portion (26) having a radially inner surface adjacent the elongated member (21) and a radially outer surface remote therefrom, an outer housing portion (27) having a radially inner surface adjacent the radially outer surface of the sleeve portion (26), bearing means (28, 29) disposed between the housing portion (27) and the sleeve portion (26) to permit relative rotation between the housing portion (27) and the sleeve portion (26), the radially inner surface of the housing portion (27) and the radially outer surface of the sleeve portion (26) defining between them a liquid lubricating medium chamber (37, 38, 39), the housing portion (27) including means defining a passageway (30) therethrough, the passageway (30) through the housing portion (27) communicating in lubricating liquid coupling relation with the liquid lubricating medium chamber (37, 38, 39) to provide liquid lubricating medium thereto, the housing portion (27) including means providing a radially inwardly extending flange (31) and the sleeve portion (26) including means providing a radially outwardly extending flange (41), the flange (41) on the sleeve portion (26) and the flange (31) on the housing portion (27) including means providing complementary axial thrust bearing surfaces (42, 43), one (42) of the complementary axial thrust bearing surfaces (42, 43) being generally smooth and the other (43) of the complementary axial thrust bearing surfaces (42, 43) including means defining perimetrally spaced boss regions (45) separated by recesses (48) for the passage of liquid lubricating medium between adjacent boss regions (45), and means (46) for coupling the recesses (48) to the chamber (37, 38, 39) so that lubricating medium pumped under pressure into the chamber (37, 38, 39) will fill the recesses (48) and flow out between the bosses (45) and the generally smooth surface (42) to lubricate between the complementary axial thrust bearing surface (42, 43).

6. The invention of claim 5 wherein the gripping device (24) is a pressurized liquid medium-actuated gripping device, the sleeve portion (26) includes means defining a passageway (32) extending longitudinally of the sleeve portion (26) and means providing a coupling passageway (33) extending between the longitudinal passageway (32) and the chamber (37, 38, 39), and means for coupling the longitudinal passageway (32) to the pressurized liquid medium-actuated gripping device (24) so that the supply of pressurized liquid to the longitudinal passageway (32) through the housing portion (27) also supplies pressurized liquid to the pressurized liquid medium-actuated gripping device (24).

7. The invention of claim 6 wherein the housing portion (27) further comprises a radially outer surface, means for providing a passageway (52) from the chamber (37, 38, 39) to the radially outer surface of the housing portion (27), an instrument (54) for measuring the pressure in the passageway (52) from the chamber (37, 38, 39) to the radially outer surface of the housing portion (27), and means for coupling the instrument (54) to the passageway (52) from the chamber (37, 38, 39) to the radially outer surface of the housing portion (27).

8. The invention of claim 5 wherein the radially outwardly extending flange (41) comprises an axially upper flange (41), the axially upper flange (41) including an axially lower surface (43), the radially outer surface of the sleeve portion (26) further comprising an axially lower flange (40) spaced from the axially upper flange (41) a distance substantially equal to the thickness of the radially inwardly extending flange (31) on the housing portion (27), the radially inwardly extending flange (31) on the housing portion (27) including an axially upper surface (42), the means providing the complementary axial thrust bearing surfaces (42, 43) on the radially outwardly extending flange (41) of the sleeve portion (26) and the radially inwardly extending flange (31) of the housing portion (27) comprising the axially lower surface (43) of the axially upper flange (41) of the sleeve portion (26) and the axially upper surface (42) of the flange (31) on the housing portion (27).

9. The invention of claim 8 wherein the axially lower flange (40) includes an axially upper surface (43) and the radially inwardly extending flange (31) on the housing portion (27) including an axially lower surface (42), the axially upper surface (43) of the lower flange (41) and the axially lower surface (42) of the radially inwardly extending flange (31) comprising second complementary axial thrust bearing surfaces (42, 43).

10. The invention of claim 9 wherein the second complementary axial thrust bearing surfaces (42, 43) include one generally smooth surface (42) and one surface (43) including means defining perimetrally spaced boss regions (45) separated by recesses (48) for the passage of liquid lubricating medium between adjacent boss regions (45), the means (46) for coupling the recesses (48) to the chamber (37, 38, 39) including means (46) for coupling the recesses (48) of the second complementary axial thrust bearing surfaces (42, 43) to the chamber (37, 38, 39).

11. The invention of claim 10 wherein the recesses (48) of the first-mentioned (42, 43) and second (42, 43) complementary axial thrust bearing surfaces comprise grooves (48) having opposed sidewalls, the opposed sidewalls of one of the grooves (48) angling away from each other (51).

12. The invention of claim 11 wherein the one (43) of the complementary axial thrust bearing surfaces (42, 43) which includes recesses (48) and the one (43) of the second complementary axial thrust bearing surfaces (42, 43) which includes recesses (48) each include a radially inner perimentral recess (46) forming the means (46) for coupling the recesses (48) of the first-mentioned and second complementary axial thrust bearing surfaces (42, 43) to the chamber (37, 38, 39).

* * * * *